United States Patent [19]

Hagen

[11] 4,237,788

[45] Dec. 9, 1980

[54] EXPLOSIVE FUSE FOR BALLISTIC PROJECTILE

[75] Inventor: Richard L. Hagen, Santa Ana, Calif.

[73] Assignee: ARES, Inc., Port Clinton, Ohio

[21] Appl. No.: 970,489

[22] Filed: Dec. 18, 1978

[51] Int. Cl.[3] ..... F42C 15/22; F42C 1/00

[52] U.S. Cl. ..... 102/245; 102/254; 102/273; 102/275

[58] Field of Search ..... 102/272–275, 102/244, 245, 254

[56] References Cited

U.S. PATENT DOCUMENTS

| | | | |
|---|---|---|---|
| 1,366,499 | 1/1921 | Schläfer | 102/273 |
| 1,781,556 | 11/1930 | Remondy | 102/272 |
| 2,054,510 | 9/1936 | Remondy | 102/275 |
| 2,415,262 | 2/1947 | Semple | 102/273 |
| 2,601,827 | 7/1952 | Brandt | 102/274 |
| 3,375,786 | 4/1968 | Marchiaro | 102/251 |
| 3,786,754 | 1/1974 | Donahue et al. | 102/275 X |
| 3,807,307 | 4/1974 | Putscher et al. | 102/275 |
| 4,004,521 | 1/1977 | Andrejkovics | 102/273 X |
| 4,013,013 | 3/1977 | Davis | 102/275 |
| 4,159,679 | 7/1979 | Eneman | 102/273 X |

FOREIGN PATENT DOCUMENTS

| | | | |
|---|---|---|---|
| 295585 | 7/1929 | United Kingdom | 102/275 |
| 524712 | 8/1940 | United Kingdom | 102/275 |

*Primary Examiner*—David H. Brown

*Attorney, Agent, or Firm*—Allan R. Fowler

[57] ABSTRACT

An elongated, aerodynamically improved ballistic projectile fuse, having an overall fuse length greater than its maximum diameter by a factor of approximately two, includes a lightweight aluminum fuse body having forward and rearward portions and an interiorily disposed firing pin with a shearable flange thereon. A steel sleeve mounted in the fuse body is provided for supporting the firing pin with a head portion thereof forwardly directed and exterior to the sleeve and for guiding the firing pin through the fuse body toward the rearward portion thereof subsequent to impact of the fuse with a target. A cap, enclosing the firing pin head, is configured for collapsing and impacting the head upon fuse impact with a target, thereby causing shearing of the firing pin flange and driving of the firing pin rearwardly toward detonation means disposed within the fuse body rearward portion. The cap is in turn enclosed by a windscreen which provides an aerodynamically streamlined, forward continuation of the fuse body. Means joining the windscreen to the sleeve enables separation therebetween on target impact, thereby enabling the windscreen to collapse the cap.

14 Claims, 5 Drawing Figures

EXPLOSIVE FUSE FOR BALLISTIC PROJECTILE

The present invention relates generally to the field of ballistic projectile fuses and, more particularly to ballistic projectile fuses capable of detonation at shallow or glancing impact angles and also of enabling target penetration of an attached projectile before detonation.

As is well known, the aerodynamic shape, or envelope, of a projectile strongly affects its ballistic characteristics. Typically, a fuse portion comprises approximately 25% of total projectile length and is generally configured to be a streamlined forward continuation of the main projectile body. Consequently, the fuse forms a significant part of the overall projectile aerodynamic envelope.

One important ballistic characteristic affected by aerodynamic envelope is projectile to target time of flight, that is, the time necessary for a fired projectile to reach a target.

Time of flight is particularly important for anti-aircraft guns because of the high speeds of modern jet aircraft. Since for ballistic projectiles no trajectory corrections can be made after firing, the guns must shoot ahead of, or lead, target aircraft in order to hit it. When shooting at very fast aircraft targets, the amount of lead must be relatively large, even at relatively short target ranges, thereby making hitting a maneuvering aircraft very difficult due to the difficulty of accurately predicting aircraft maneuvers. It follows that as time of projectile flight is reduced, less target lead is necessary and a higher hit probability is achieved.

Ballistic projectile designers have long known that reduced projectile time of flight may be achieved, by increasing projectile length to diameter ratio, for example, by increasing length of the fuse. Aerodynamic considerations constrain such elongated fuses to a gradually tapering shape, resulting in a very slender tip portion.

When constructed of conventional steel materials, elongated fuses are relatively heavy, compared to conventional fuses. This increased weight tends to forwardly shift the entire projectile center of gravity, which in turn, generally causes a decrease of projectile in-flight stability and a consequent increase in projectile point of impact error (dispersion) to unacceptable levels.

An additional problem related with slender elongated fuses is that such fuses tend to glance off targets when impacting at small impact angles. When this occurs, the fuse usually does not detonate the projectile.

An associated problem caused by internal space constraints of a slender fuse, is difficulty of combining sensitive fuse elements with a reliable time delay mechanism so that the fuse, and consequently the main projectile charge, will not detonate until the projectile has at least partially penetrated the target. Such time delay is important since projectiles are usually more effective in destroying or damaging targets when exploded inside the target.

In accordance with our present invention, an aerodynamically improved ballistic projectile fuse, for a projectile body having an explosive charge therein, includes a fuse body having forward and rearward portions with the rearward portion adapted for attachment to the projectile body.

A firing pin, having a forward head portion and a rearward striking portion, is supported in the fuse body with the head portion forwardly directed by means also operative for guiding rearward movement of the firing pin toward the fuse body rearward portion in response to fuse impact with a target.

Enclosing the firing pin head is a cap configured for collapsing and impacting the firing pin head upon fuse impact with a target, thereby driving the firing pin rearwardly toward the fuse body rearward portion. An exterior windscreen, extending the length of the assembled fuse, encloses the cap to provide an aerodynamically streamlined, forward continuation of the fuse body. When attached to the projectile body, the elongated fuse extends overall projectile length beyond that provided by conventional fuses, thereby enhancing ballistic time of flight characteristic.

The windscreen is joined to the firing pin supporting means by means enabling easy separation therebetween upon impact of the windscreen with a target, thereby enabling the windscreen to collapse the cap to initiate firing, it being important that the windscreen separate from the firing pin support means upon target impact to enable collapse of the cap for impacting the firing pin. If the windscreen does not separate easily, collapse of the cap will be impeded and reduce fuse sensitivity will result.

Disposed within the fuse body rearward portion, and responsive to engagement with the firing pin striking portion, are detonation means for causing ignition of an explosive charge disposed within the projectile body to which the fuse is attached.

In an exemplary embodiment, the fuse body is formed from a relatively lightweight, low strength material, such as aluminum, the firing pin supporting means including, in contrast, a sleeve formed of a high strength material, such as steel.

The relatively lightweight fuse body material allows fabrication of an elongated fuse having a total weight that does not substantially forwardly shift the center of gravity of the assembled projectile and hence does not decrease projectile in-flight stability. Use of high strength material for the sleeve assures integrity of a path along which the firing pin travels subsequent to fuse impact with a target, despite impact deformation of the fuse body.

To support the firing pin at a forward position within the cap, the sleeve, is disposed within a forward portion of the fuse body and extends forwardly therefrom. In this manner, the sleeve supports the firing pin with the head portion thereof exterior of the sleeve and forward of the fuse body.

Time delay is provided by forming the sleeve to be substantially longer than the firing pin, the time delay being approximately equal to the transit time of the firing pin along the sleeve after shearing of a firing pin regaining flange. To utilize the entire sleeve length and to expose the firing pin to impact by the cap, the sleeve supports the firing pin with the head portion thereof forwardly of the sleeve.

It is to be appreciated that the elongated fuse facilitates the use of a long sleeve, thereby providing a greater time delay than is otherwise possible with conventional projectile fuses having a shorter overall length.

The firing pin has a generally cylindrical body and a flange thereabout intermediate the head and rearward striking portions. To prevent premature movement of the firing pin and hold the firing pin head proximate the cap, the firing pin flange is sized to prevent rearward passage of the firing pin along the sleeve, the flange being further configured for shearing upon impact on the firing pin head portion by the cap, to thereby enable driving of the firing pin rearwardly along the sleeve.

Included in the firing pin are means defining a circumferential groove adjacent of the flange on a side thereof facing the rearward striking portion, the groove accommodating any distortion of the firing pin which may occur during flange severing, which might otherwise inhibit passage of the firing pin along the sleeve.

Increased fuse sensitivity is enabled, even at shallow striking angles, by a rounded firing pin head operative with the generally hemispherically shape of the cap interior for directing oblique target impact forces onto the firing pin along the axis thereof, thereby assuring proper shearing of the firing pin flange.

In order to prevent the windscreen from impeding collapse of the cap upon fuse impact with a target, the sleeve includes a shoulder with a generally conical exterior surface, sloping toward a forward end of the sleeve, which engages a mating interior conical surface of the windscreen. Accordingly, the sleeve conical surface functions as a ramp to separate the windscreen upon rearward motion of the windscreen upon target impact. Separation is further enhanced by a weakened region formed within the windscreen forwardly of the shoulder, such region being easily ruptured to allow the windscreen to collapse against the cap upon target impact.

Additionally, the tapered sleeve shoulder by a wedging action, enhances penetration of the fuse body into a target.

The foregoing and other features and advantages of the present invention will be apparent in the following specification describing the preferred embodiment of the invention, taken in conjunction with the accompanying drawings in which.

Figure 1:
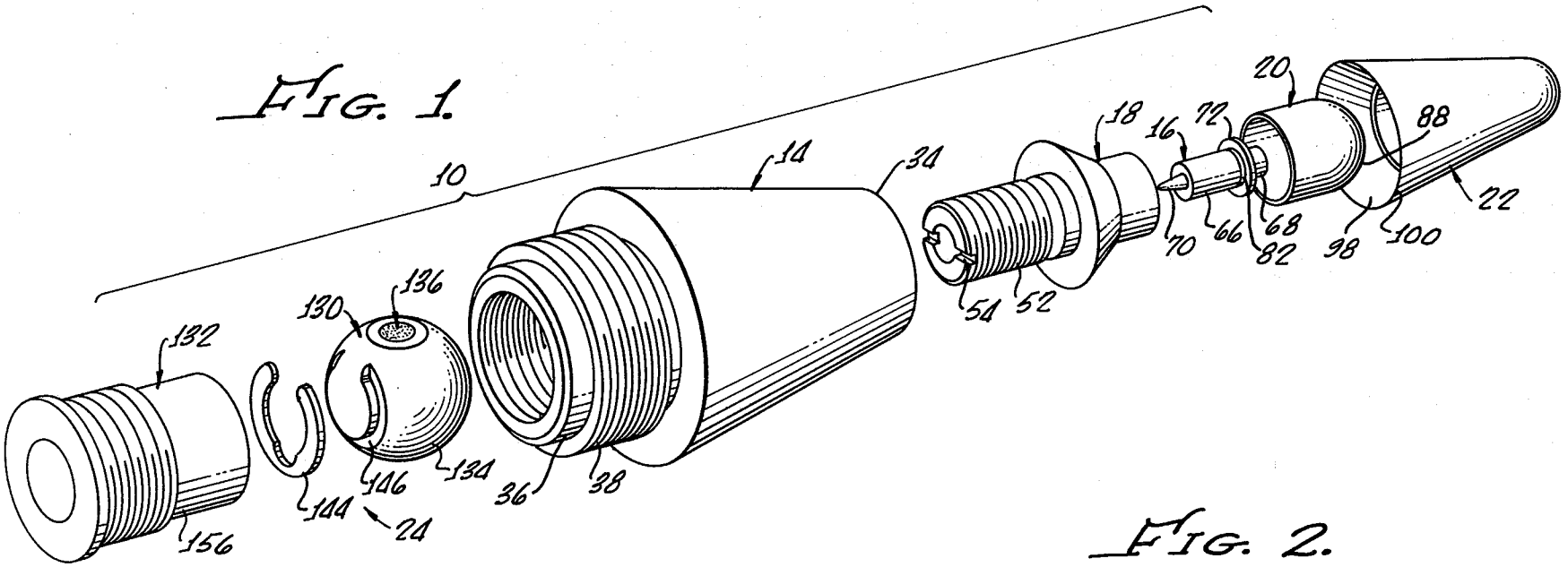
FIG. 1 is an exploded perspective view of a percussion fuse according to the present invention.
Figure 2:
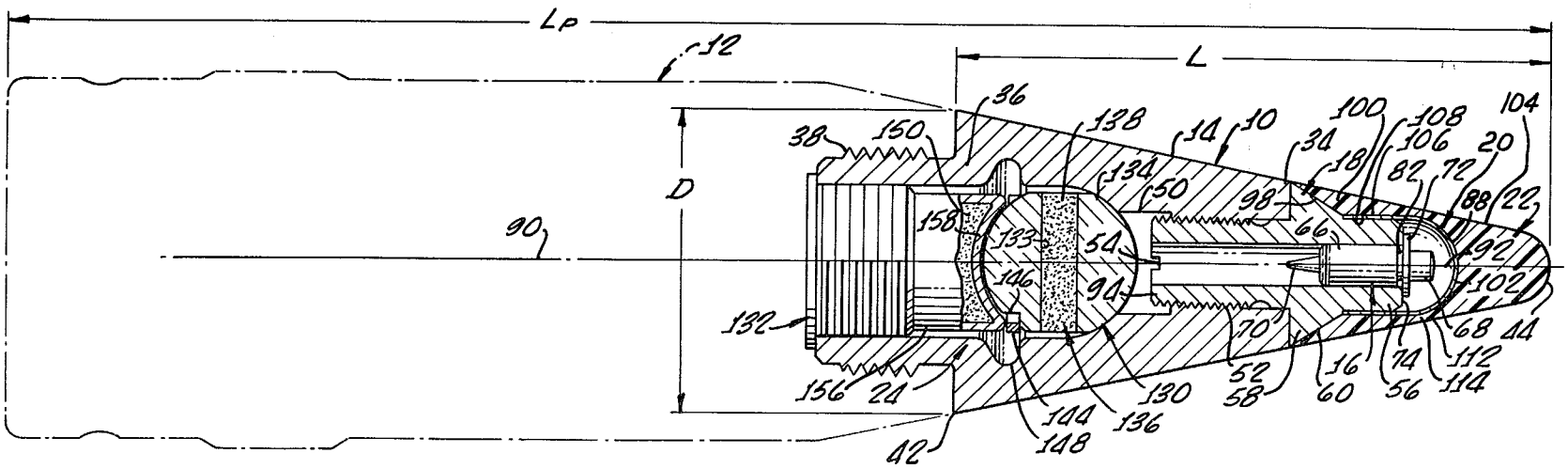
FIG. 2 is a cross-sectional view of the percussion fuse of FIG. 1, attached to a projectile body, showing the sleeve, firing pin, cap, windscreen and detonating means portions of the fuse with the detonating means in an armed condition.
Figure 3:
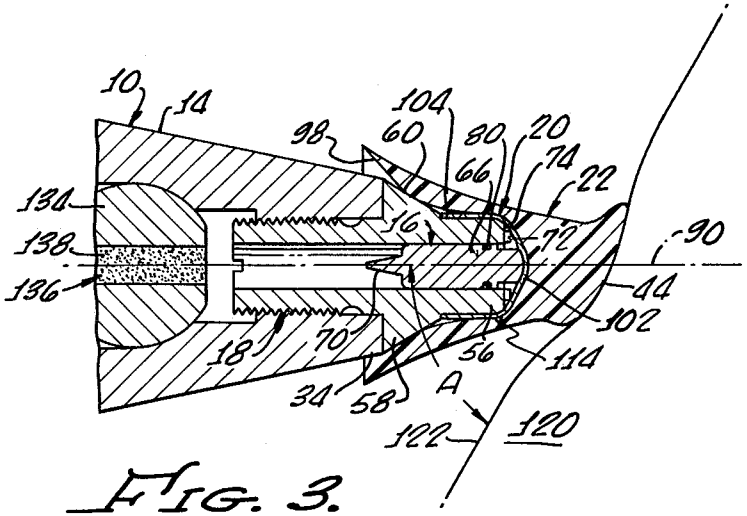
FIG. 3 is a cross-sectional view showing impact of the fuse against a target and showing consequent separation of a windscreen portion from the sleeve, and collapsing of the cap onto a firing pin head, thereby shearing the firing pin flange, by forcing it against the sleeve, and driving the firing pin rearwardly along the sleeve towards the detonating means.

Referring to FIGS. 1, 2 and 3, an aerodynamically improved ballistic projectile fuse 10, adapted for attaching to a conventional projectile body 12, generally includes fuse body 14, a firing pin 16, a sleeve 18, a cap 20, a windscreen 22, and detonation means 24.

The fuse body 14 has a forward portion 34 and a rearward portion 36, with the rearward portion being adapted for attachment to the projectile body 12 by means of a threaded portion 38.

In order to provide a smooth and continuous exterior surface transistion between the fuse body 14 and projectile body 12, each has an equal exterior diameter D at their junction 42 (FIG. 2), the diameter D being the maximum diameter of the fuse 10.

Preferably, the fuse body 14 is formed of a relatively lightweight material, such as aluminum alloy 7705-TC pr 2024-TC, so that the fuse body can be made substantially longer than a conventional fuse body without disturbing the center of gravity of the assembled projectile 40. Thus, forming the fuse body 14 from lightweight alloys enables overall fuse length L, measured from the junction 42 with the projectile body 12 to a forward tip 44 of the windscreen 22, to be greater than the maximum diameter D by a factor of approximately two, without having an adverse effect on the center of gravity of the projectile to which it is attached.

As a result, projectile overall length Lp is increased and the time of flight of the projectile 40 can be significantly reduced. For example, when used with a 20 mm caliber anti-aircraft projectile body (such as U.S. Army type M-505A3) the elongated fuse 10 extends overall projection length by over 15%, thereby reducing time of flight (to approximately 2000 meters) by approximately 30%.

The fuse body 10 has an axial cavity 50 formed therethrough which is configured for accommodating the detonation means 24 in the rearward portion 36 thereof. A rearward threaded portion 52 of the sleeve 18 secures the sleeve within the cavity 50, in the fuse body forward portion 34. A slot 54, formed at the base of the sleeve 18 and accessable through the cavity 50 before installation of the detonation means 24, facilitates tightening the sleeve in position, with a forward generally cylindrical tip portion 56 thereof extending forwardly of the fuse body 14.

Figure 4:
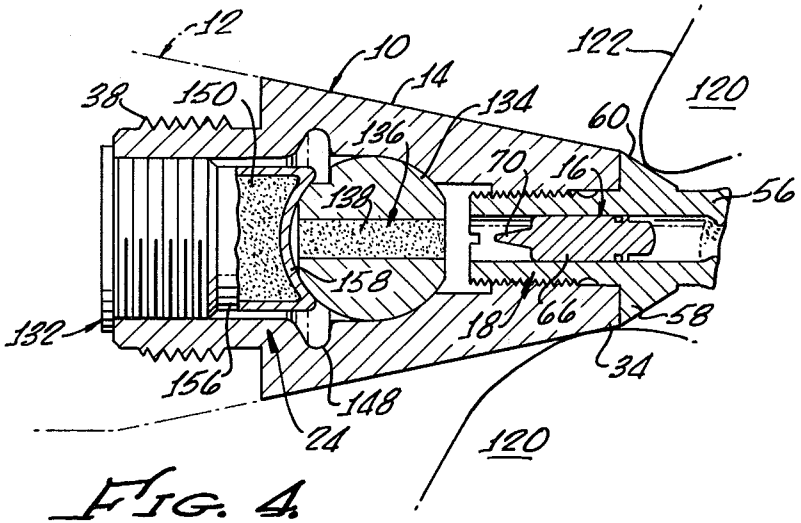
FIG. 4 is a cross-sectional view showing initial penetration of the fuse into a target, with a sleeve shoulder operating to enlarge the target opening; and, FIG. 5 is a cross-section view showing penetration of the projectile body beneath the surface of the target and ignition of the detonation means.
Figure 5:
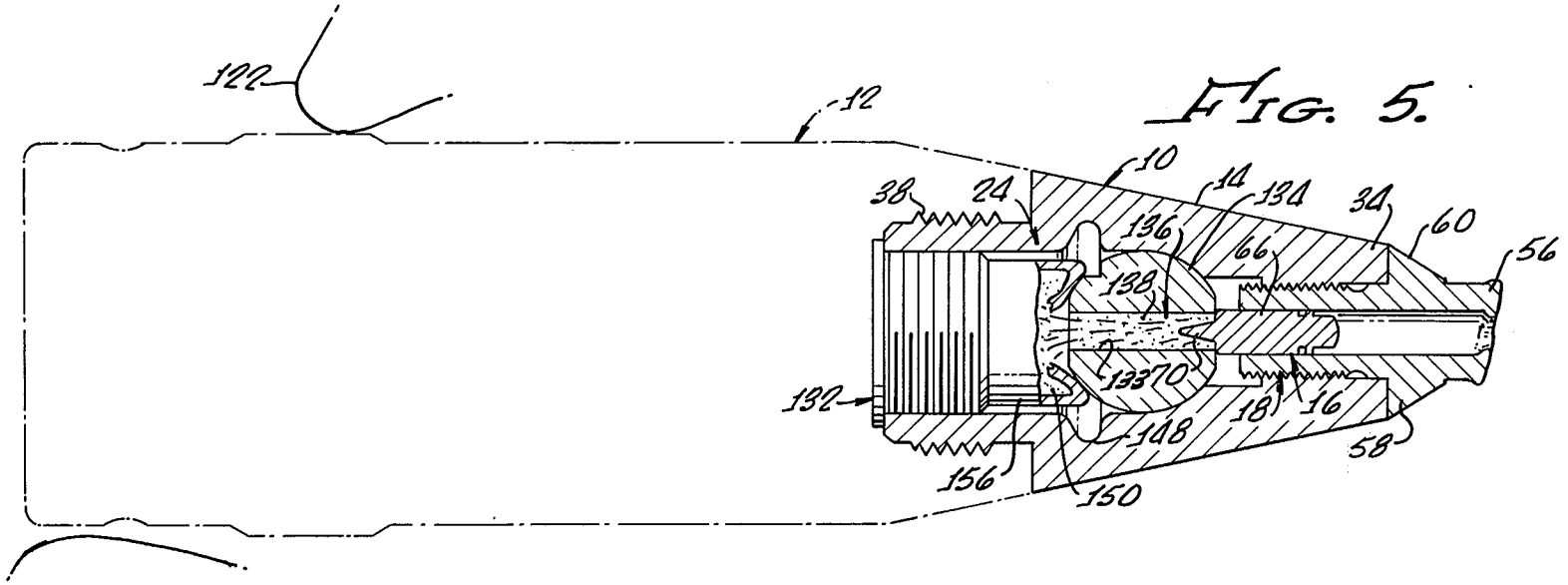

To enhance penetrating ability of the fuse 10, the sleeve 18 is formed of a realtively high strength material, such as steel, and includes a shoulder 58 having a generally conical exterior surface 60 which tapers forwardly to the narrower tip 56. Because the sleeve tip 56 is more slender than the fuse body, it more easily penetrates a target 120, (FIGS. 3 and 4), the conical surface 60 on the shoulder 58 operating to wedge a larger opening in the target to thereby facilitate penetration of the fuse body 14, and hence the projectile body 12 (FIG. 5).

In addition, since the sleeve 18 is formed of a high strength material upon impact the firing pin 16 is assured an undistorted path to the detonation means 24, even though the weaker fuse body 14 becomes distorted.

Although the fuse body 14 and the sleeve 18 could alternatively be formed from a single piece of material, it should be appreciated that the extended fuse length 10, precludes use of heavy high strength material. Using a strong, relatigely heavy material, such as steel, for the sleeve 18, enables the fuse body 14 to be constructed of a lightweight, relative low strength material, such as aluminum, without sacrificing fuse penetration capability.

As is more particularly described below, the shoulder 58 with its conical surface 60 also provide means enabling joining the windscreen 22 to the sleeve 18 and for enabling the windscreen to separate and to collapse the cap 20 upon impact with the target 62 (FIG. 3).

As best shown in FIGS. 1 and 2, the firing pin 16 has a generally cylindrical body portion 66, a head portion 68, a relatively sharp striking portion 70 and an outwardly projecting, circumferential flange 72 intermediate the head and striking portions. When assembly, the firing pin body 66 is disposed within the sleeve 18, with the flange 72 supported, or bearing against, by a forward end surface 74 of the sleeve. Th flange 72, which has a diameter larger than the inside diameter of the sleeve 18, is configured for shearing or severing as the pin is driven rearwardly relative to the sleeve in response to impact on the firing pin head 68.

In order that the flange 72 shears cleanly, that is without jagged edges or the like which may impede subsequent passage of the firing pin 16 along the sleeve 18, the firing pin is preferably formed of a heat treatable metal, such as steel. By so forming the firing pin, fracture strength of the flange can be controlled as is well known in the art. In contrast, use of ductile material might not allow clean shearing of the flange and impeded travel of the pin 14 down the sleeve 18 would result.

After shearing of the firing pin flange 72, travel of the firing pin 16 through the sleeve 18 has, in some instances, also been found to be impeded by a slight expansion or distortion 80 (FIG. 3) which the shearing tends to cause in the firing pin body 66, just rearward of the flange. To accomodate such expansion and distortion, a shallow, circumferential groove 82 (FIGS. 1 and 2) is formed into the pin body 66 rearwardly adjacent to the flange 72. Any shear caused expansion occurs in the region of such groove 82 and hence does not project outwardly beyond the fuse body surface, the diameter of which is such as to enable free passage of the firing pin 16 through the sleeve 16.

Proper ignition of the detonation means 24 is promoted by forming the firing pin striking portion 70 to be pointed or tapered, as is well known in the art. The firing pin head 68 is rounded for more effective engagement by the cap 20, as will be discussed below in greater detail.

Forward portions of the firing pin are enclosed by the cap 20, which is preferably assembled by press fitting onto the sleeve tip 56. A forward region 88 of the cap 20 is formed in a generally hemispherical shape, which, in conjunction with the rounded firing pin head 68, acts to resolve impact forces along a fuse axis 90 for effective shearing of the firing pin flange 72. That is, the rounded head 68 and cap 20 prevent or reduce twisting or "cocking" of the firing pin 16 within the sleeve 18 when the head is impacted by the cap.

Although calculations can be used, an empirical procedure may be employed to determine proper cap thickness. If the cap 20 is too thin, upon target impact, the firing pin head 68 may punch through and the flange 72 may not shear with firing pin travel to the detonation means 24 being prevented. On the other hand, if the cap 20 is too thick, it may not be sufficiently deformable to collapse onto the firing pin head and shearing of the flange 72 may again be prevented. It has been found, as an illustration, that for a 20 mm projectile fuse, a cap 20 formed of steel should have a thickness of approximately 0.010 inches.

It is important that the firing pin 16 is enclosed by the cap 20 with a space or gap 92 therebetween, so that upon impact the collapsing cap strikes the firing pin head 68 sharply. When the head 68 and the cap 20 are in contact, prior to fuse impact, it has been experimentally determined that reliable shearing of the flange 72 does not occur. Although dimensions of the gap 92 may vary depending on the caliber of the fuse and the materials employed, for a 20 mm projectile a gap on the order of approximately 0.020 to 0.040 inches as been found to enable proper firing pin impact.

As above discussed, with regard to aerodynamic time of flight, the fuse 10 has a length substantially greater than that of such currently used fused as the type M505A3. This greater length also allows use of a sleeve 18 which is substantially longer than the firing pin 16. Hence, relatively a substantial time interval is required for the firing pin to travel from an initial, forward position to a rearward end 94 of the sleeve for detonator impact. Depending on target characteristics and projectile velocity at target impact, the delay time required for the firing pin to travel through the sleeve 18 allows the projectile to penetrate, for example, several inches in the case of a target aircraft, into the target before detonation of the main charge occurs, destructive capability being thereby greatly enhanced.

For fuse weight and projectile center of gravity considerations, as hereinabove discussed, the windscreen is preferably formed of a very lightweight material, such as nylon tape 612. Although various windscreen forming methods may be employed, molding is particularly effective for producing the large numbers usually required.

A generally conical interior surface 98 of a rearward windscreen portion 100 engages the sleeve shoulder 58 at the exterior surface 60, thereof upon installation of the windscreen 22 over the cap 20. Also, when assembled, a hemispherical interior surface 102 of a forward windscreen portion 104 engages the generally hemispherical cap 20. The windscreen 22 is retained in position by a press-fit between a rearward portion of the cap 106 and a generally cylindrical interior surface portion 108 of the windscreen which connects the conical and hemispherical interior surfaces 98, 102 thereof.

Upon target impact, FIG. 3, the sleeve shoulder 58 functions as a ramp to cause separation of the windscreen rearward portion 100 thereby enabling rearward movement of windscreen to collapse the cap 20. To further aid in the separation, the windscreen and the cap are constructed, relative to each other, so that a relatively thin, or weakened region 114 exists between an exterior surface 112 of the windscreen 22 and the hemispherical inner surface 102. This weaken region 114, which ordinarily ruptures upon separation of the windscreen rearward portion 100, facilitates rearward movement of the windscreen forward portion 104 upon target impact to collapse the cap 20.

It should be appreciate that if the cap 20 were not present, a relatively weak material, such as nylon, could not be used for constructing the windscreen 22, because the firing pin head 68 would tend to imbed itself into the windscreen upon impact, thereby preventing shearing the flange 72.

The elongated fuse 10 causes the windscreen 22 to strike a target 120, before the fuse body 14 and enables detonation at a very shallow angle of incidence, A, (FIG. 3) measured between a target surface 122 and the fuse axis 90, as small as about 15°.

Included in the fuse detonation means 24 is a conventional ball ignitor 130 (FIGS. 1 and 2) and a booster 132 disposed within the cavity 50 in the fuse body rearward portion 36. Briefly, the ball ignitor 130 comprises a steel ball 134, having an axial bore 133 filled with an impact sensitive explosive charge 138.

An expandable C-ring 144 fitted into an off-center annular slot 146 in a ball 134 prevents the ball from rotating within the cavity 50. The ignitor 130 is oriented, upon assembly, in the rear cavity 50, with the bore 136 generally perpendicular to the longitudinal fuse body axis 90 (FIG. 2). In such unarmed orientation, if the firing pin 16 is inadvertently driven down the sleeve 18, for example, by dropping the projectile, the pin will strike only the steel ball 134 and not the explosive charge 138, and hence projectile ignition will not occur.

Upon firing of the projectile, however, centrifugal forces, caused by spin imparted by the projectile by a gun barrel, arm the fuse (FIG. 4) by causing inertial explaning and release of the C-ring 144 into a recess 148, and and for then causing the unbalanced ball 134 to rotate within the cavity 50 to an orientation aligning the bore 136 (and explosive charge 138 therein) with the fuse body axis 90. In this armed condition, upon target impact, the firing striking portion 70 will impact the explosive charge 138 after the firing pin 16 is driven down the sleeve 18.

Genrally, the ball ignitor charge 138 itself is not of sufficient explosive size to reliably assure ignition of the main projectile explosive charge (not shown). Hence, as is well known in the art, the booster 132, disposed to the rear of the ball ignitor 130 includes a larger explosive charge 150 which fires the projectile main charge after ignition by the ball ignitor. The booster charge 150 is contained within a thin walled cup 156 screwed into the fuse body rearward portion 36. When assembled, the booster charge 150 is separated from the ball 134 by a generally hemispherical or cup shaped booster wall 158, which is in abutment with, and conforms, to the ball surface. Upon ignition of the ignitor explosive charge 138, by the firing pin 16, the wall 158 is ruptured enabling immediate ignition of the booster charge 150, which, in turn, causes exploding of the projectile main explosive charge.

Although apparent from the foregoing description, operation of the fuse 10 is summarized as follows. When the projectile 12 is fired, centrifical forces caused by projectile spin arm the fuse in the manner described and as shown in FIG. 4. Impact of the fuse 10 with the target 126 (FIG. 3) causes the windscreen rearward portion 100 to separate from the sleeve 18 and causes both the windscreen forward portion and cap 20 to collapse, to strike the firing pin head 68. Because the firing pin 16 is not held tightly within the cap 20, the firing pin flange 72 does not shear at the exact instant the windscreen 22 separates and collapses; hence, such flange does not inhibit initial collapse of the cap 20. Thus, rather than pushing against the firing pin 16, the collapsing cap 20 strikes the firing pin in a hammer-like manner to cause clean shearing of the flange 72.

Accordingly, the rapidly collapsing cap 20 imparts sufficient momentum to the firing pin 16, after shearing of the flange 72, to drive the pin rearwardly through the sleeve 18 and into impact engagement with the ball ignitor 120, with sufficient force to cause detonation of the charge 138.

The narrow tip 56 of the high strength sleeve 18 enhances initial penetration of the fuse 10 into the target 120 while the sleeve shoulder 58 wedges apart or expands the opening caused by the tip (FIG. 4). This instantaneous target penetration occurs while the firing pin 16 is still traveling along the sleeve 18. By the time the firing pin 16 impacts the ball ignitor 130 and detonation of the main projectile charge is caused, the projectile body will ordinarily have penetrated substantially beneath a target surface 120—(assuming a "soft" target such as an airplane). Hence the projectile is more effective in causing target damage that if detonation occurred outside the target.

Although there has been described hereinabove a particular arrangement of a percussion fuse in accordance with the invention, for the purpose of illustrating the manner in which the invention may be used to advantage, it will be appreciated that the invention is not limited thereto. Accordingly, any and all modification, variations or equivalent arrangements which may occur to those skilled in the art, should be considered to be within the scope of the invention as defined in the appended claims.

I claim:

1. A projectile fuse for a ballistic projectile body having a explosive charge contained herein, comprising:

a fuse body having forward and rearward portions, said rearward portion being adapted for attachment to the projectile body;

a firing pin having a forward head portion and a rearward ignitor striking portion;

means for supporting the firing pin with the head portion forwardly directed and for guiding rearward movement of the firing pin toward the fuse body rearward portion;

cap means for enclosing the firing pin forward head portion and responsive to fuse impact with a target for collapsing and impacting the firing pin forward head portion and for thereby driving the firing pin toward the fuse body rearward portion;

windscreen means for enclosing the cap means and for providing an aerodynamically streamlined forward continuation of the fuse body;

means joining the windscreen means to the firing pin supporting means for enabling separation therebetween, thereby enabling the windscreen means to collapse said cap means upon impact of the fuse with a target; and detonation means, disposed within the fuse body rearward portion and responsive to impace by the firing pin striking portion for causing detonation of the explosive charge contained within the projectile body.

2. The projecticle fuse according to claim 1, wherein the firing pin supporting means includes an elongate sleeve disposed within the fuse body forward portion and extending forwardly therefrom.

3. The projectile fuse according to claim 2, wherein the sleeve supports the firing pin with the head portion thereof exterior to the sleeve and the sleeve length is substantially greater than the firing pin length, thereby causing a time delay between the time of the fuse impacts a target and the time the firing pin striking portion impacts the detonation means in the rearward portion of the fuse body, said time delay being substantially equal to the transit time of the firing pin along the sleeve.

4. The projectile fuse according to claim 1 or 2, wherein the means joining the windscreen means to the firing pin supporting means is configured for enhancing penetration of the fuse body into a target.

5. The projectile fuse according to claim 2, wherein the fuse body is formed of a relatively lightweight, low strength material and the sleeve is formed of a relatively heavy, high strength material.

6. The projectile fuse according to claim 5, wherein the fuse body is formed of aluminum alloy, the sleeve is formed of steel and the windscreen means is formed of nylon.

7. The projectile fuse according to claim 5 or 6, wherein the fuse body rearward portion has a maximum diameter adjacent the projectile body and the fuse has an overall length, measured from the projectile body to a forward tip of the windscreen means, greater than about twice said maximum diameter.

8. The projectile fuse according to claim 2, wherein the sleeve is formed of steel and includes a shoulder portion having a generally conical exterior surface tapering toward a forward end of the sleeve, and having a tip portion with a diameter less than a minimum diameter of the fuse body disposed forwardly of said shoulder portion.

9. The projectile fuse according to claim 8, wherein the windscreen means includes means defining a generally conical interior surface for engaging the conical exterior surface of the sleeve.

10. The projectile fuse according to claim 9, wherein the windscreen includes means defining a weakened region forwardly of said conical interior surface for further facilitating separation between the sleeve and the windscreen.

11. The projectile fuse according to claim 2, wherein the firing pin is formed having a flange intermediate the head and striking portions, said flange being of a size to prevent passage of the firing pin along the sleeve and being configured for shearing upon impact to the firing pin head portion to enable the firing pin, subsequent to flange shearing, to travel rearwardly along the sleeve.

12. The projectile fuse according to claim 11, wherein the firing pin has a generally cylindrical body and the flange is circumferentially formed thereabout.

13. The projecticle fuse according to claim 12, including means defining a circumferential groove in the firing pin body rearwardly adjacent to the flange for absorbing any firing pin distortion due to flange shearing, thereby facilitating passage of the firing pin along the sleeve subsequent to flange shearing.

14. The projectile fuse according to claim 12, wherein the firing pin head portion is rounded and the cap means includes means defining a generally heimspheral shape for directing target impact forces onto the firing pin along a flange axis, thereby assuring firing pin flange shearing upon target impact.

* * * * *

UNITED STATES PATENT AND TRADEMARK OFFICE

CERTIFICATE OF CORRECTION

PATENT NO. : 4,237,788

DATED : December 9, 1980

INVENTOR(S) : Richard Hagen

It is certified that error appears in the above-identified patent and that said Letters Patent are hereby corrected as shown below:

At column 4, line 67, change "assembly" to --assembled--

At column 5, line 2, change "Th" to --The--

At column 5, line 67, change "as" to --has--

At column 6, line 3, change "fused" to --fuses--

At column 6, line 19, change "tape" to --type--

At column 7, line 8, change the second "by" to --to--

At Claim 1, line 40, change "impace" to --impact--

At Claim 13, line 11, change "projecticle" to --projectile--

Signed and Sealed this

*Third* Day of *November 1981*

[SEAL]

*Attest:*

GERALD J. MOSSINGHOFF

*Attesting Officer*

*Commissioner of Patents and Trademarks*